US006592445B2

(12) United States Patent
Lee

(10) Patent No.: US 6,592,445 B2
(45) Date of Patent: Jul. 15, 2003

(54) METHOD AND APPARATUS FOR SORTING COINS

(75) Inventor: Jongsuk Lee, Kyunggi-do (KR)

(73) Assignee: Royal Sovereign, Inc., Icheon (KR)

( * ) Notice: Subject to any disclaimer, the term of this patent is extended or adjusted under 35 U.S.C. 154(b) by 126 days.

(21) Appl. No.: 09/814,245

(22) Filed: Mar. 21, 2001

(65) Prior Publication Data

US 2002/0137453 A1 Sep. 26, 2002

(51) Int. Cl.[7] ..... G07D 3/02
(52) U.S. Cl. ..... 453/13; 453/33; 453/57
(58) Field of Search ..... 453/12, 13, 33, 453/49, 57, 9

(56) References Cited

U.S. PATENT DOCUMENTS

| | | | | | |
|---|---|---|---|---|---|
| 1,927,265 | A | * | 9/1933 | Hume | 453/13 |
| 2,080,389 | A | * | 5/1937 | Rasmusen et al. | 453/13 |
| 3,696,968 | A | * | 10/1972 | Jaech | 453/33 |
| 4,275,751 | A | | 6/1981 | Bergman | 453/5 |
| 4,407,312 | A | * | 10/1983 | Davila et al. | 453/33 |
| 5,238,446 | A | * | 8/1993 | le Hong et al. | 453/57 |
| 5,902,178 | A | | 5/1999 | Perkitny | 453/9 |
| 6,165,063 | A | | 12/2000 | Perktiny | 453/9 |

FOREIGN PATENT DOCUMENTS

| | | | | |
|---|---|---|---|---|
| DE | 0226166 | * | 9/1910 | 453/13 |
| GB | 2203582 | * | 10/1988 | 453/33 |
| JP | 0118199 | * | 10/1978 | 453/13 |

* cited by examiner

*Primary Examiner*—Eileen D. Lillis
*Assistant Examiner*—Paul T. Chin
(74) *Attorney, Agent, or Firm*—Roberts Abokhair & Mardula, LLC

(57) ABSTRACT

The coin sorting apparatus includes a coin carrying vessel and a coin sorting plate. The coin carrying vessel has a plurality of coin carrying slots, and the coin sorting plate has a plurality of coin sorting slots. Each of the coin carrying slots consists of a large arc and a small arc, and therefore, a large coin is settled into the large arc, while a small coin is settled in the small arc. Accordingly, when a coin carrying vessel with the coin carrying slots formed therein revolves, a large coin drops into a large coin sorting slot, while a small coin drops into a small coin sorting slot. Thus the sorted and dropped coins are guided by a plurality of guides respectively, thereby making it possible to sort coins according to their sizes.

10 Claims, 4 Drawing Sheets

METHOD AND APPARATUS FOR SORTING COINS

FIELD OF THE INVENTION

The present invention relates to an apparatus for sorting coins, in which a plurality of differently sized rectangular coin sorting slots are formed in a coin sorting plate, and a plurality of almost elliptical coin carrying slots are formed in a coin carrying vessel. Each of the coin carrying slots consists of a large arc and a small arc, and therefore, a large coin is settled into the large arc, while a small coin is settled into the small arc of the coin carrying slot. Accordingly, when the coin carrying vessel with the coin carrying slots formed therein revolves, a large coin drops into a large coin sorting slot, while a small coin drops into a small coin sorting slot. Thus the sorted and dropped coins are guided by a plurality of guides respectively, thereby making it possible to sort coins according to their sizes.

BACKGROUND INFORMATION

Generally, in the commercial transactions and in the financial transactions, large quantities of coins are required at the transaction sites or at the financial organizations. Accordingly, there are the requirements that coins be accurately sorted, and these requirements are being increased day by day. Generally, the conventional coin sorting apparatus, such as disclosed in U.S. Pat. No. 4,275,751, includes: a coin carrying vessel for carrying the coins; and a coin sorting device for sorting the coins thus carried. The coins which are carried by the coin carrying vessel to the coin sorting device are sorted in the following manner. That is, when the coin sorting device revolves together with the coins, if the coins encounters a sorting hole, then the coins are discharged owing to the centrifugal force. The coins which are sorted in this manner are received into receiving vessels respectively according to their sizes. In this apparatus, the coin sorting device which sorts the coins according to their sizes are the principal part.

In the above described conventional coin sorting apparatus, within the passage through which the coins rollingly pass, there are formed a plurality of coin sorting slots having different sizes respectively. Thus when the coins rollingly move through the above mentioned passage, if the coins fall into the coin sorting slots, then these coins are dropped and sorted. That is, a coin orbiting plate has a plurality of differently sized elongate slots, and when the coin orbiting plate revolves, the orbiting coins drop after passing through the elongate slots according to their sizes. The coin sorting apparatus in which the coin sorting slots are formed in the coin passage shows a slow sorting speed. Meanwhile, the coin sorting apparatus in which the coin orbiting plate having the plurality of coin sorting slots shows a low accuracy of the sorting.

BRIEF SUMMARY OF THE INVENTION

The present invention is intended to overcome the above described disadvantages of the conventional techniques.

Therefore it is an object of the present invention to provide an apparatus for sorting coins, in which the sorting speed is high, and the sorting accuracy is also superior.

In achieving the above object, the apparatus for sorting coins according to the present invention is constituted such that the sorting of coins is realized as soon as the coins are carried. Accordingly, the structure of the coin carrying device and the structure of the coin sorting device are different from those of the conventional coin sorting apparatus. The coin carrying device includes a plurality of coin carrying slots, and each of the coin carrying slots consists of: an arcuate portion of a large radius, and an arcuate portion of a small radius. Thus in the large radius arcuate portion, there can be settled a large coin, while a small coin can be settled in the small radius arcuate portion. Further, a plurality of coin sorting slots are formed on a coin sorting plate, and the coin carrying slots revolvingly pass over the coin sorting slots. The coin sorting slots are arranged around the coin sorting plate, and the sizes of the circularly arranged coin sorting slots become larger as advancing clockwise. The first coin sorting slot allows the smallest coins to be dropped through it, while the last coin sorting slots allows the largest coins to be dropped through it. The lower portion of the coins are supported at the round supporting lines until the last moment when the coins are dropped. So as to make sure for the coins to be supported at the round supporting lines, the large or small coins are made to contact with the small radius arcuate portion. As described above, the apparatus of the present invention ensures that the coins are sorted simultaneously with the their carrying. Therefore, the coins are put into the coin carrying vessel at a constant rate, and one coin can be put into each of the coin carrying slots. Accordingly, the thickness of the shell of the coin carrying vessel is made to be same as or smaller than the thickness of the thinnest coin. Even if two or more coins are stacked in one slot, the stacked coins are dropped when the coin carrying slot orbits to be overlapped with the next coin sorting slot.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE INVENTION

The present invention will be described in detail referring to the attached drawings.

The coin sorting apparatus according to the present invention includes: a coin inputting device, a coin sorting plate, a coin carrying vessel, a driving device for rotating the coin carrying vessel, a plurality of guides for guiding the sorted coins so as for the sorted coins not to be mixed, and a plurality of coin receiving vessels for receiving the coins thus guided. The description of the present invention will be focused on a coin carrying device and a coin sorting device.

Figure 1:
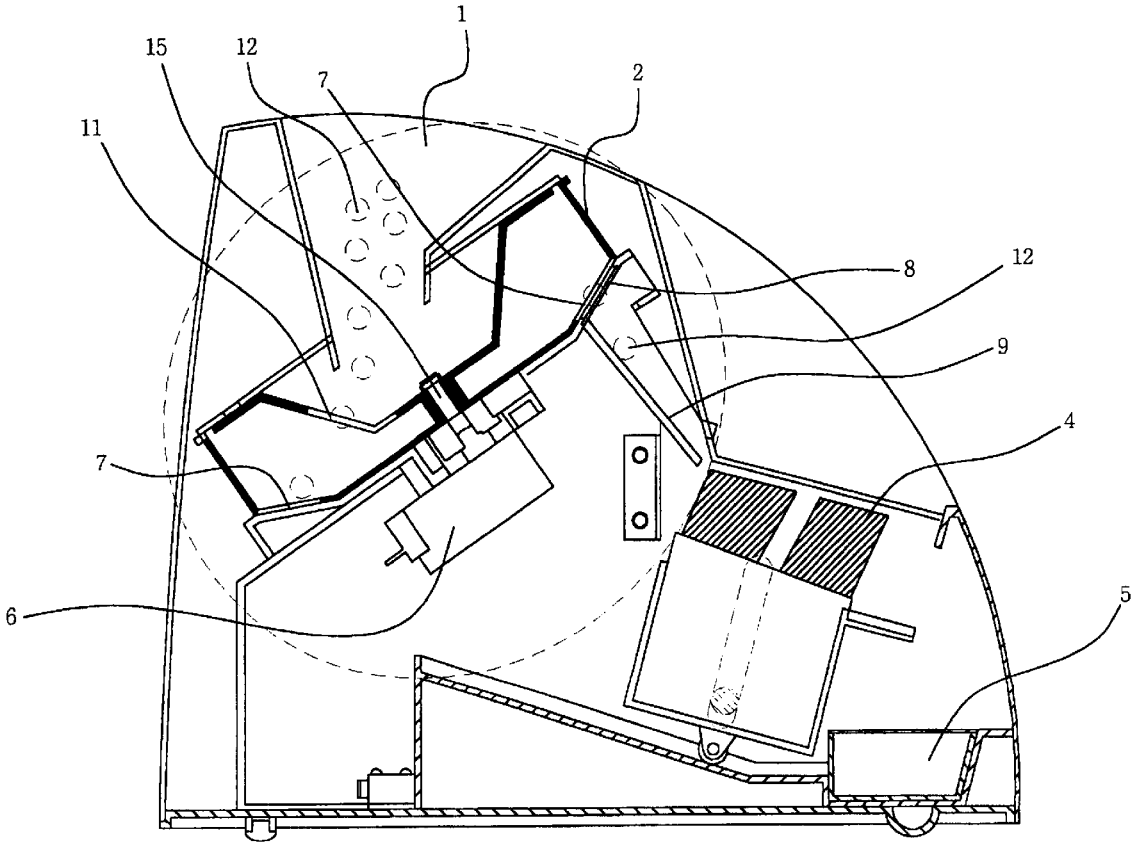
FIG. 1 is a sectional view showing the whole structure of the coin sorting apparatus according to the present invention.
Figure 2:
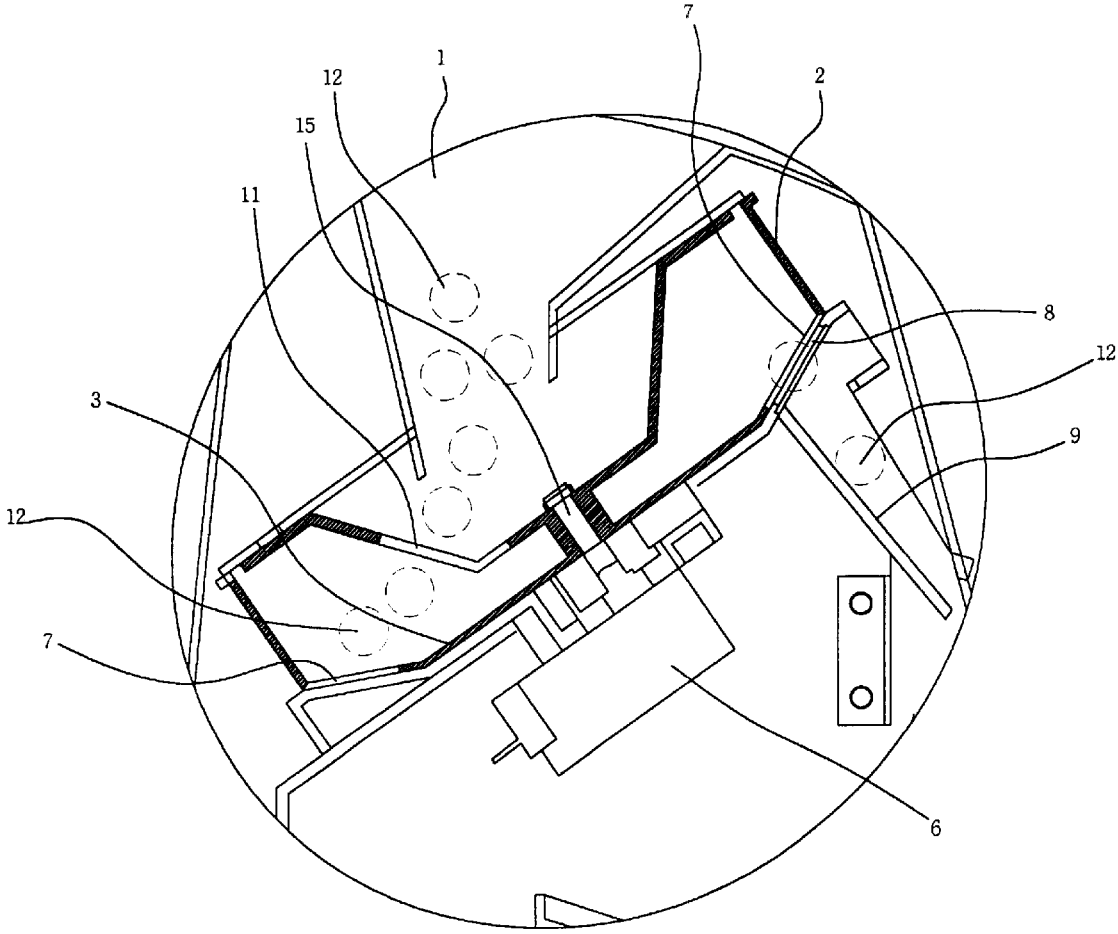
FIG. 2 is an enlarged view of a part of the apparatus of FIG. 1.
Figure 3:
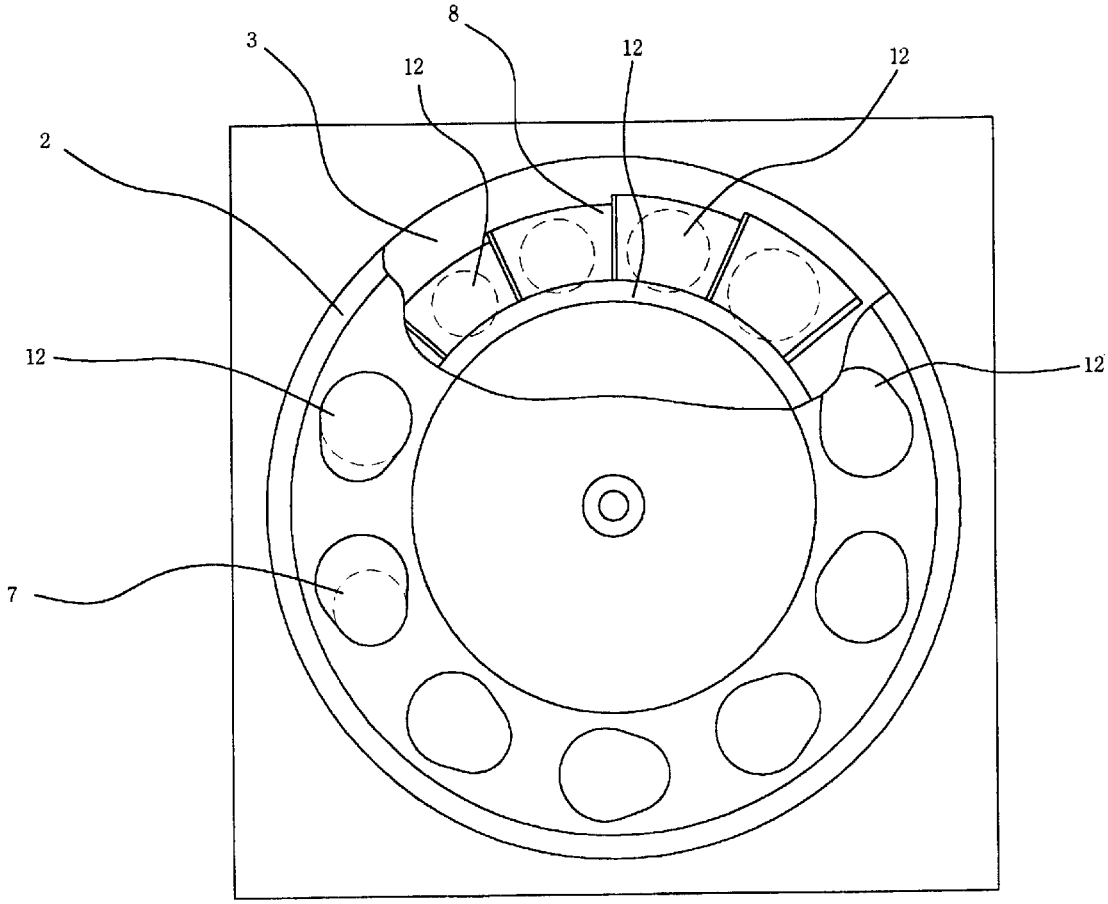
FIG. 3 illustrates in detail the coin carrying vessel and the coin sorting plate of the apparatus according to the present invention.
Figure 4:
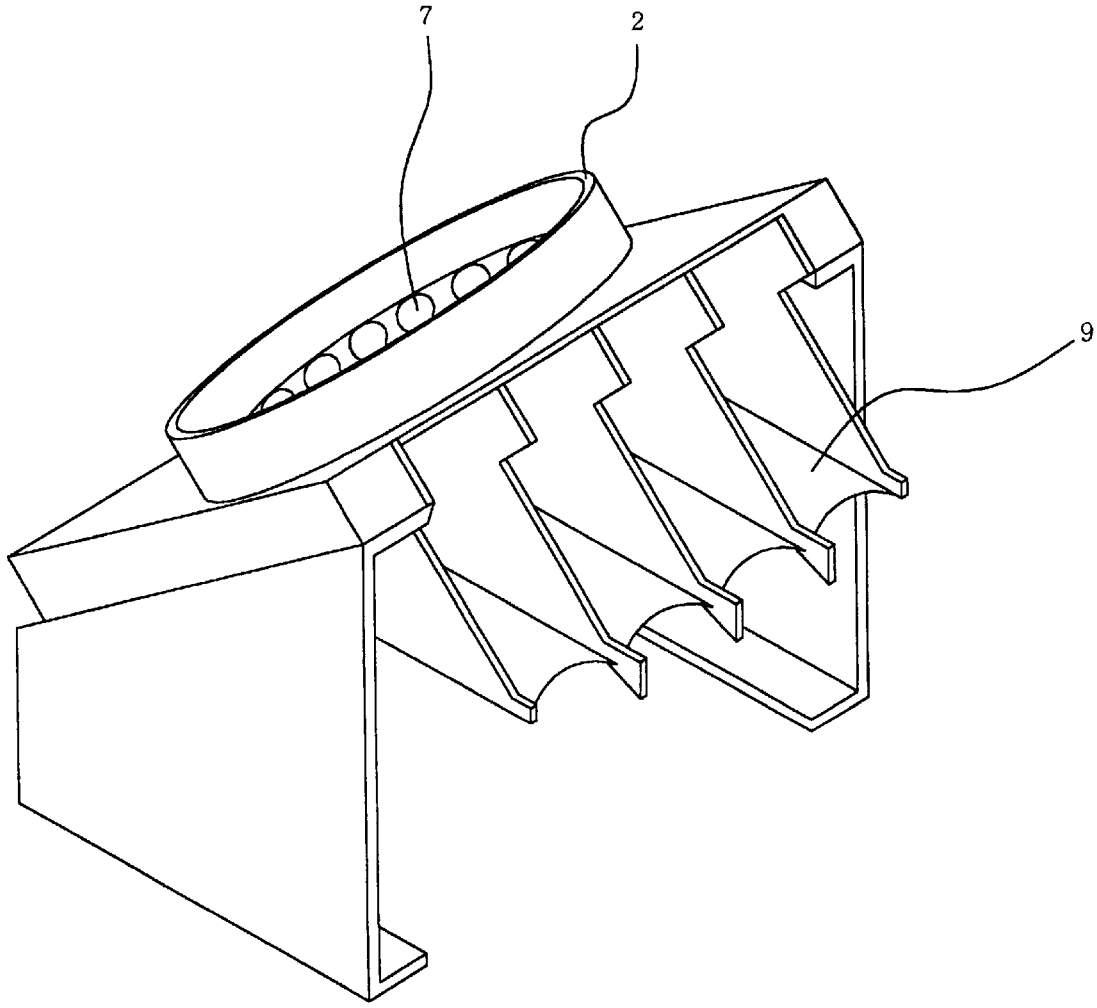
FIG. 4 is a perspective view showing the coin sorting apparatus of the present invention in which the coins are being sorted.

FIG. 1 is a sectional view showing the entire structure of the coin sorting apparatus according to the present invention. FIG. 2 is an enlarged view of a part of the apparatus of FIG. 1. FIG. 3 illustrates in detail the coin carrying vessel and the coin sorting plate of the apparatus according to the present invention. FIG. 4 is a perspective view showing the coin sorting apparatus of the present invention in which the coins are being sorted.

The coin sorting plate 3 is shaped like a dish, and is inclined in its peripheral portion as shown in FIG. 2. The coin carrying vessel 2 is shaped like a bowel, and its lower portion is inclined as shown in FIG. 2 like the coin sorting plate 3. The coin carrying vessel 2 and the coin sorting plate 3 are overlapped together as shown in FIG. 2, and the coin carrying vessel 2 freely revolves over the coin sorting plate 3. On a conic portion at the lower periphery of the coin carrying vessel 2, there are formed a plurality of almost elliptical coin carrying slots 7 as shown in FIGS. 2 and 3. The coin carrying slots 7 are all the same size. On a matching conic portion at the periphery of the coin sorting plate, there are formed a plurality of rectangular coin sorting slots 8, and these coin sorting slots are different in their relative sizes to each other, with the sizes arranged in a sequential order.

The coin sorting plate 3 is fixedly installed on the body of the apparatus, while the coin carrying vessel 2 is rotatably installed on a revolution shaft 15. Thus the coin carrying vessel 2 revolves over the coin sorting plate 3. When the coin carrying vessel 2 revolves one revolution, all of the coin carrying slots 7 of the coin carrying vessel 2 pass over all the coin sorting slots 8 of the coin sorting plate 3. Under the coin sorting slots 8, there are formed a plurality of coin guides 9, so that the sorted coins can be guided to a plurality of receiving vessels 4 respectively according to the sizes of the sorted coins 12. If the receiving vessels 4 are full with the sorted coins, then the coins 12 can overflow, and therefore, a spilled coin receiving vessel is installed at a side of the coin receiving vessels 4.

The coin sorting plate 3 is inclined relative to horizontal in a total view, while the coin carrying vessel 2 which is coupled with the coin sorting plate 3 is also inclined relative to horizontal in a total view. The coin carrying vessel 2 revolves clockwise in this embodiment.

The coin sorting plate 3 is fixedly installed on the body of the apparatus, while the coin carrying vessel 2 is rotatably secured on the revolution shaft 15 of a driving device 6.

The sizes of the coin sorting slots 8 of the coin sorting plate 3 are slightly larger than the object coins respectively, so that the respective coins can smoothly pass through the coin sorting slots 8. Further, the sizes of the coin sorting slots 8 are sequentially arranged from the smallest one to the largest one. That is, the sizes of the coin sorting slots 8 increase stepwisely going clockwise, so that the small coins can be sorted earlier, and the large coins can be sorted later. That is, the small coin sorting slots 8 should not allow the large coins 12 to pass through, and therefore, the coins are made to be supported at the supporting lines 2.

To describe it again, the coins 12 are put into an inlet 1, and when the coin carrying vessel 2 revolves, the coins are settled into the coin carrying slots 7 in a sequential manner so as to be moved into the coin sorting slots 8. The size of the coin carrying slots is such that the arc of the front portion of the slot is same as that of largest coin, and that the arc of the rear portion of the slot is same as that of smallest coin, as shown in FIG. 3. Therefore, the front portion (large portion) and the small portion (rear portion) of the coin carrying slots correspond to the size of the largest coin and the size of the smallest coin. The thickness of the shell of the coin carrying vessel 2 is same as or thinner than the thickness of the coin, and therefore, each of the coins is loaded accurately into each of the coin carrying slots 7.

That is, the coins 12 which are put into the coin inlet 1 and which fall into the size range of the coins are individually settled into each of the coin carrying slots 7 so as to be moved into the coin sorting slots 8 which are arranged in a circular form on the coin sorting plate 3. If the coin is smaller than the coin sorting slot 8, then the coin drops, and therefore, the coins 12 of different sizes are sequentially sorted to be received into the coin receiving vessels 4. The coins which overflow from the coin receiving vessels 4 are collected to a spilled coin receiving vessel 5.

Now, the present invention will be described based on an example.

In order to sort a mixture of coins 12 of, for example, dimes, pennies, nickels, and quarters, this coin mixture was put into the coin inlet 1, and the coin carrying vessel 2 is rotated clockwise. Then the smallest coins 12, such as dimes, are settled into the relevant coin carrying slot 7, in the rear portion (small portion) of the coin carrying slot 7. In the same manner, the pennies, nickels and quarters are settled into the coin carrying slots 7 respectively, with the smaller ones settling into the small portions and the with the larger ones settling into large portions of the coin carrying slots 7.

In this process, the coin carrying vessel 2 with the coins 12 contained therein revolves, and therefore, all the coin carrying slots 7 of the coin carrying vessel 2 pass over all the coin sorting slots 8 once in a revolution. In this process, the coins which are settled within the coin carrying slots 7 are supported by the coin sorting plate 3 in the gravitational direction, and therefore, if a coin comes above a suitable coin sorting slot 8, then the coin drops. The sizes of the coin sorting slots 8 increase in a stepwise fashion in the advancing direction, and therefore, the smallest coins drop first, and the largest coins drop last in a sequential manner. Thus a dime can drop only into the coin sorting slot 8 which is suitable for dimes, and therefore, the dimes, pennies, nickels, quarters, etc. can drop only into the relevant guides 9, thereby making it possible to sort the coins.

According to the present invention as described above, when the coin carrying vessel with the coin carrying slots formed therein revolves, the coins are respectively settled into the coin carrying slots. Further, when the coin carrying vessel revolves, if the coin which is settled in the coin carrying slot comes over a suitable coin sorting slot of the coin sorting plate, then the coin drops to the coin guide. The coin sorting slots have different sizes, and therefore, coins of different sizes can be sorted in a quick and accurate manner.

I claim:

1. An apparatus for sorting coins, comprising:

a coin carrying vessel rotatably installed on a revolution shaft, said vessel including a conic portion at a lower periphery, said conic portion having a plurality of coin carrying slots a fixed distance from said shaft, said slots consisting of a large arc and a small arc so as to make coins settled therein; and a coin sorting plate fixedly installed on a body of the apparatus directly below said coin carrying vessel, said sorting plate having a matching conic portion at its periphery, said matching conic portion including a plurality of coin sorting slots of increasing size in a direction of rotation at said fixed distance from said shaft for making coins of suitable sizes pass therethrough, whereby coins of different sizes are sorted in an accurate and speedy manner.

2. The apparatus as claimed in claim 1, wherein said coin sorting slots are sized slightly larger than a coin denomination said slot is supposed to sort.

3. The apparatus as claimed in claim 1, wherein the large arc of said coin carrying slots is sized to carry the largest coin to be sorted and said small arc is sized to carry the smallest coin to be sorted.

4. The apparatus as claimed in claim 1, wherein the coin carrying vessel has a shell thickness dimensioned the equal to or less than a coin thickness so as to allow only one coin to settle within each coin carrying slot.

5. The apparatus as claimed in claim 1, wherein said revolution shaft, said coin carrying vessel and said coin sorting plate are inclined relative to horizontal.

6. A method for sorting coins, comprising:

gravity feeding coins into a rotating coin carrying vessel that includes a plurality of coin carrying slots located on a conic portion at a lower periphery of said rotating coin carrying vessel, wherein said slots consist of a large arc and a small arc so as to make coins settled therein; and rotating said slots over a fixed coin sorting plate having a plurality of coin sorting slots of increasing size in a direction of rotation on a conic peripheral portion of said coin sorting plate to cause coins of suitable sizes to pass therethrough, so as to sort coins of different sizes in an accurate and speedy manner.

7. The method claim 6, further comprising sizing said coin sorting slots slightly larger than a coin denomination said slot is supposed to sort.

8. The method claim 6, further comprising sizing the large arc of said coin carrying slots to carry the largest coin to be sorted and sizing said small arc to carry the smallest coin to be sorted.

9. The method claim 6, further comprising allowing only one coin to settle within each coin carrying slot.

10. The method claim 6, further comprising inclining said coin sorting vessel and said coin sorting plate relative to horizontal.

* * * * *